US012458121B2

(12) United States Patent
Popwell et al.

(10) Patent No.: US 12,458,121 B2
(45) Date of Patent: Nov. 4, 2025

(54) CONTACT LENS PACKAGE WITH DRAINING PORT

(71) Applicant: Johnson & Johnson Vision Care, Inc., Jacksonville, FL (US)

(72) Inventors: Sam Jonathan Popwell, Jacksonville, FL (US); Daniel Graham Ward, Bishop's Stortford (GB); Stephen Sams, Bassingbourn (GB); Ismail Akram, Bassingbourn (GB)

(73) Assignee: Johnson & Johnson Vision Care, Inc., Jacksonville, FL (US)

( * ) Notice: Subject to any disclaimer, the term of this patent is extended or adjusted under 35 U.S.C. 154(b) by 0 days.

(21) Appl. No.: 18/775,909

(22) Filed: Jul. 17, 2024

(65) Prior Publication Data

US 2024/0365939 A1 Nov. 7, 2024

Related U.S. Application Data

(62) Division of application No. 17/953,947, filed on Sep. 27, 2022, now Pat. No. 12,064,018.

(51) Int. Cl.
*A45C 11/00* (2006.01)

(52) U.S. Cl.
CPC ..... *A45C 11/005* (2013.01)

(58) Field of Classification Search
CPC ..... A45C 11/005; A45C 11/046; A45C 2011/006; B65D 81/261; B65D 2231/025; B65B 25/008

(Continued)

(56) References Cited

U.S. PATENT DOCUMENTS 3,088,830 A 5/1963 Graham
3,089,500 A 5/1963 Stalcup (Continued)

FOREIGN PATENT DOCUMENTS

BR 202016013147 4/2019
CN 101662967 3/2010

(Continued)

OTHER PUBLICATIONS

International Search Report & Written Opinion, International Patent Application No. PCT/IB2023/059175, dated Dec. 20, 2023, 6 pages.

(Continued)

*Primary Examiner* — Steven A. Reynolds
(74) *Attorney, Agent, or Firm* — CASIMIR JONES, S.C.; Thomas J. Lyneis

(57) ABSTRACT

A contact lens package includes a base having a proximal end and a distal end, a solution well between the proximal end and the distal end, a contact lens support in the solution well, a top opening between the proximal end and the distal end and over the contact lens support, and a via through a wall of the base adjacent the well, the via providing a fluid exit for solution within well. A removable lid overlying the top opening may be removably affixed over the top opening such that a user may remove the lid to access the contact lens. Using this package, fluid can be drained away from the contact lens in the package before removal from the package by a user, thus providing good adhesion between a user's finger or applicator and the lens over prior packaging.

18 Claims, 8 Drawing Sheets

(58) Field of Classification Search
USPC ..... 206/5.1; 134/901
See application file for complete search history.

(56) References Cited

U.S. PATENT DOCUMENTS 3,159,308 A 12/1964 Lawrence
3,369,656 A 2/1968 Skinner
3,414,117 A 12/1968 Leeds
3,473,886 A 10/1969 Leeds
3,490,806 A 1/1970 Lopez-Calleja
3,524,455 A 8/1970 Hoogesteger
3,584,908 A 6/1971 Ray
3,977,517 A 8/1976 Kadlecik et al.
4,187,574 A 2/1980 Wrue
4,392,569 A 7/1983 Shoup
4,415,076 A 11/1983 Campbell
4,444,307 A * 4/1984 Jermyn ..... G02C 13/008 134/901
4,495,313 A 1/1985 Larsen
4,512,601 A 4/1985 Jacobstein
4,659,782 A 4/1987 Spinelli
4,659,783 A 4/1987 Spinelli
4,691,820 A 9/1987 Martinez
4,889,664 A 12/1989 Kindt-Larsen et al.
4,942,959 A 7/1990 Sauber
4,986,414 A 1/1991 Ashley et al.
5,031,622 A 7/1991 Lahaye
5,039,459 A 8/1991 Kindt-Larsen et al.
5,053,208 A 10/1991 Seamons
5,099,987 A 3/1992 Bieri
5,227,039 A 7/1993 Pankow
5,244,981 A 9/1993 Seidner et al.
5,314,960 A 5/1994 Spinelli
5,331,067 A 7/1994 Seidner et al.
5,371,147 A 12/1994 Spinelli
5,375,698 A 12/1994 Eward et al.
5,407,062 A 4/1995 Shannon
5,415,275 A 5/1995 Girimont
5,452,027 A 9/1995 Tylec
5,474,169 A 12/1995 Bauman
5,515,964 A 5/1996 Bauman
5,609,246 A 3/1997 Borghorst et al.
5,620,088 A 4/1997 Martin
5,695,049 A 12/1997 Bauman
5,704,468 A 1/1998 Lust et al.
5,711,416 A 1/1998 Bauman
5,722,536 A 3/1998 Pierce
5,732,990 A 3/1998 Yavitz
5,760,100 A 6/1998 Nicolson et al.
5,776,999 A 7/1998 Nicolson et al.
5,789,461 A 8/1998 Nicolson et al.
5,849,811 A 12/1998 Nicolson et al.
5,853,085 A 12/1998 Luttrell
5,908,133 A * 6/1999 Luburic ..... B65D 81/261 220/571
5,965,631 A 10/1999 Nicolson et al.
5,998,498 A 12/1999 Vanderlaan
6,010,001 A 1/2000 Osborn, III
6,087,415 A 7/2000 Vanderlaan
6,138,212 A 10/2000 Cummings
6,138,312 A 10/2000 Cummings
6,253,912 B1 7/2001 Oneill
6,260,695 B1 7/2001 Tasber
6,276,797 B1 8/2001 Shannon
6,280,530 B1 8/2001 Pankow
6,286,666 B1 9/2001 Umdasch
6,289,907 B1 9/2001 Horian et al.
RE37,558 E 2/2002 Abrams
6,367,929 B1 4/2002 Maiden et al.
6,401,915 B1 6/2002 Faxe
6,572,165 B2 6/2003 Faxe
6,822,016 B2 11/2004 McCabe et al.
6,867,245 B2 3/2005 Iwata et al.
6,943,203 B2 9/2005 Vanderlaan
7,086,526 B2 8/2006 Newman
7,225,919 B2 6/2007 Hamilton
7,247,692 B2 7/2007 Laredo
7,249,848 B2 7/2007 Laredo
7,275,275 B2 10/2007 Pankow
7,398,877 B1 7/2008 Nelson
7,410,050 B2 8/2008 Py
7,426,993 B2 9/2008 Coldrey
7,441,650 B2 10/2008 Tanaka
7,461,740 B2 12/2008 Newman
7,540,376 B2 6/2009 Mahieu
7,553,880 B2 6/2009 Nicolson et al.
7,666,921 B2 2/2010 McCabe et al.
7,786,185 B2 8/2010 Rathore
7,819,241 B2 10/2010 Post-Smith
7,832,551 B2 11/2010 Newman
7,832,552 B2 11/2010 Newman
7,850,002 B2 12/2010 Newman
7,938,255 B2 5/2011 Newman
7,956,131 B2 6/2011 Arnold
8,022,158 B2 9/2011 Rathore
8,104,608 B2 1/2012 Newman
D658,077 S 4/2012 Newman
8,251,205 B2 8/2012 Azera
8,273,802 B2 9/2012 Laredo
8,399,538 B2 3/2013 Steffan
8,450,387 B2 5/2013 McCabe et al.
8,470,906 B2 6/2013 Rathore
8,487,058 B2 7/2013 Liu
8,507,577 B2 8/2013 Zanini
D690,207 S 9/2013 Newman
8,637,621 B2 1/2014 Iwata et al.
8,703,891 B2 4/2014 Broad
8,833,548 B2 9/2014 Hsieh
8,881,892 B1 11/2014 Linhardt
8,937,110 B2 1/2015 Alli
8,937,111 B2 1/2015 Alli
8,940,812 B2 1/2015 Reboul
9,044,075 B2 6/2015 Linhardt
9,056,878 B2 6/2015 Fujisawa
9,057,821 B2 6/2015 Broad
9,067,720 B2 6/2015 Howell
9,095,195 B2 8/2015 Mori
9,125,808 B2 9/2015 Alli
9,140,825 B2 9/2015 Alli
9,156,934 B2 10/2015 Alli
9,170,349 B2 10/2015 Mahadevan
9,206,544 B2 12/2015 Zeng
9,244,196 B2 1/2016 Scales
9,244,197 B2 1/2016 Alli
9,297,928 B2 3/2016 Molock
9,297,929 B2 3/2016 Scales
9,320,566 B1 4/2016 Alston et al.
9,358,736 B2 6/2016 Wang
9,576,609 B2 2/2017 Huang
9,668,558 B2 6/2017 Clamp
9,701,458 B2 7/2017 Barrows
D804,323 S 12/2017 Harrison
D805,920 S 12/2017 Clamp
9,839,270 B2 12/2017 Howell
D813,537 S 3/2018 Miura
10,092,075 B2 10/2018 Barre
10,138,042 B2 11/2018 Fawdington
10,194,724 B2 2/2019 Newman
10,364,082 B2 7/2019 Coon
10,368,621 B2 8/2019 Barre
10,463,127 B2 11/2019 Kim
10,577,166 B2 3/2020 Barrows
10,661,964 B2 5/2020 Tokarski
D899,080 S 10/2020 Yasuda
D899,081 S 10/2020 Yamamoto
10,901,236 B2 1/2021 Schweizer
10,926,944 B2 2/2021 Huang
11,071,644 B2 7/2021 Greenwood
11,077,969 B2 8/2021 Newman
11,136,176 B2 10/2021 Almond
11,229,266 B2 1/2022 Almond et al.
11,628,998 B2 4/2023 Ho
11,649,099 B2 5/2023 Ellis
11,751,654 B2 9/2023 Lansing

(56) References Cited

U.S. PATENT DOCUMENTS

| | | | | |
|---|---|---|---|---|
| 12,064,018 | B2 * | 8/2024 | Popwell | A45C 11/005 |
| 12,357,068 | B2 * | 7/2025 | Sullivan | A45C 11/005 |
| 2001/0017271 | A1 | 8/2001 | Yavitz | |
| 2002/0158477 | A1 | 10/2002 | Faxe | |
| 2002/0163212 | A1 | 11/2002 | Py | |
| 2004/0134005 | A1 | 7/2004 | Pankow | |
| 2004/0238380 | A1 | 12/2004 | Newman | |
| 2005/0087453 | A1 | 4/2005 | Mahieu et al. | |
| 2005/0103649 | A1 | 5/2005 | Vulcu et al. | |
| 2005/0218012 | A1 | 10/2005 | Tanaka et al. | |
| 2006/0151584 | A1 * | 7/2006 | Wonnacott | B65D 81/264 229/119 |
| 2006/0201103 | A1 | 9/2006 | Tokarski et al. | |
| 2006/0213783 | A1 | 9/2006 | Tokarski | |
| 2006/0213784 | A1 * | 9/2006 | Tokarski | B65D 81/22 206/5.1 |
| 2006/0219577 | A1 | 10/2006 | Newman | |
| 2006/0260956 | A1 | 11/2006 | Stachowski | |
| 2006/0260957 | A1 | 11/2006 | Hamilton | |
| 2007/0000792 | A1 | 1/2007 | Newman et al. | |
| 2007/0164576 | A1 | 7/2007 | Kim | |
| 2008/0011619 | A1 | 1/2008 | Newman | |
| 2008/0047848 | A1 * | 2/2008 | Tokarski | B65D 75/366 206/5.1 |
| 2008/0078681 | A1 | 4/2008 | Newman | |
| 2008/0170201 | A1 | 7/2008 | Filippo | |
| 2009/0121370 | A1 | 5/2009 | Barrows | |
| 2009/0139879 | A1 | 6/2009 | Tokarski | |
| 2009/0200182 | A1 | 8/2009 | Post-Smith | |
| 2010/0048847 | A1 | 2/2010 | Broad | |
| 2010/0072082 | A1 | 3/2010 | Kang | |
| 2010/0187140 | A1 | 7/2010 | Tokarski et al. | |
| 2011/0017243 | A1 | 1/2011 | Voss | |
| 2012/0267262 | A1 | 10/2012 | Wang | |
| 2013/0091613 | A1 | 4/2013 | Meltzner | |
| 2013/0277242 | A1 | 10/2013 | Mori | |
| 2014/0001059 | A1 | 1/2014 | Hsieh et al. | |
| 2014/0027462 | A1 | 1/2014 | Willat | |
| 2014/0027465 | A1 | 1/2014 | Howell et al. | |
| 2014/0246337 | A1 | 9/2014 | Newman | |
| 2015/0014187 | A1 | 1/2015 | Gilman | |
| 2015/0150346 | A1 | 6/2015 | Yasuda | |
| 2015/0173474 | A1 | 6/2015 | Barrows | |
| 2016/0198825 | A1 | 7/2016 | Fawdington | |
| 2016/0309962 | A1 * | 10/2016 | Hanson | A47J 36/08 |
| 2017/0006984 | A1 * | 1/2017 | Sheardown | A45C 11/005 |
| 2017/0172269 | A1 | 6/2017 | Lin | |
| 2018/0134475 | A1 | 5/2018 | Newman et al. | |
| 2018/0340622 | A1 | 11/2018 | Godfrey | |
| 2019/0046353 | A1 | 2/2019 | Greenwood et al. | |
| 2019/0133275 | A1 | 5/2019 | Newman | |
| 2019/0263580 | A1 * | 8/2019 | Pickard | B65D 81/261 |
| 2019/0322417 | A1 * | 10/2019 | Hurt | A01G 9/022 |
| 2020/0229560 | A1 | 7/2020 | Almond et al. | |
| 2020/0229561 | A1 | 7/2020 | Almond et al. | |
| 2020/0229562 | A1 | 7/2020 | Almond et al. | |
| 2020/0229563 | A1 | 7/2020 | Almond et al. | |
| 2020/0231351 | A1 | 7/2020 | Almond et al. | |
| 2020/0383440 | A1 | 12/2020 | Newman | |
| 2021/0139229 | A1 | 5/2021 | Huang | |
| 2022/0330671 | A1 | 10/2022 | Bruchon | |
| 2022/0365368 | A1 | 11/2022 | Greenwood et al. | |
| 2023/0083028 | A1 | 3/2023 | Popwell | |
| 2023/0276917 | A1 | 9/2023 | Popwell | |
| 2024/0122321 | A1 * | 4/2024 | Popwell | A45C 11/005 |

FOREIGN PATENT DOCUMENTS

| | | | |
|---|---|---|---|
| CN | 111759065 | | 10/2020 |
| DE | 4415003 | | 6/1995 |
| DE | 202006004323 | | 5/2006 |
| EP | 0269367 | | 6/1988 |
| EP | 3045071 | | 7/2016 |
| EP | 2768465 | B1 | 9/2019 |
| FR | 2712398 | | 5/1995 |
| FR | 2777360 | | 10/1999 |
| GB | 2551530 | | 12/2017 |
| JP | H01279222 | | 11/1989 |
| JP | H10313928 | | 12/1998 |
| JP | 2001046134 | | 2/2001 |
| JP | 5184925 | | 1/2013 |
| JP | 2014218255 | | 11/2014 |
| JP | 6004912 | B2 | 10/2016 |
| JP | 2016179837 | A | 10/2016 |
| JP | 6129238 | | 4/2017 |
| JP | 6129239 | | 4/2017 |
| JP | 6339322 | B2 | 5/2018 |
| KR | 100768522 | | 10/2007 |
| KR | 20080066930 | | 7/2008 |
| KR | 20080090252 | | 10/2008 |
| KR | 20090060075 | | 6/2009 |
| KR | 20100002433 | A | 1/2010 |
| KR | 101495874 | | 2/2015 |
| KR | 20160064382 | | 6/2016 |
| KR | 20190003113 | | 12/2019 |
| KR | 200490803 | | 2/2020 |
| NL | 2000268 | | 4/2008 |
| TW | 200930318 | | 7/2009 |
| TW | D159617 | | 4/2014 |
| TW | D172590 | | 12/2015 |
| WO | WO 99/21519 | | 5/1999 |
| WO | WO 2002088780 | | 11/2002 |
| WO | WO 2003022321 | | 3/2003 |
| WO | WO 2005/006062 | | 1/2005 |
| WO | WO 2005/055760 | | 6/2005 |
| WO | WO 2005073105 | | 8/2005 |
| WO | WO 2005/082721 | | 9/2005 |
| WO | WO 2006068583 | | 6/2006 |
| WO | WO 2006105179 | | 10/2006 |
| WO | WO 2008061992 | | 5/2008 |
| WO | WO 2008120954 | | 10/2008 |
| WO | WO 2009/059231 | | 5/2009 |
| WO | WO 2009069265 | | 6/2009 |
| WO | WO 2012165209 | | 12/2012 |
| WO | WO 2012168964 | | 12/2012 |
| WO | WO 2013058712 | | 4/2013 |
| WO | WO 2013/134547 | | 9/2013 |
| WO | WO 2013/136361 | | 9/2013 |
| WO | WO 2013/153582 | | 10/2013 |
| WO | WO 2014185354 | | 11/2014 |
| WO | WO 2014195588 | | 12/2014 |
| WO | WO 2015150704 | | 10/2015 |
| WO | WO 2017/137738 | | 8/2017 |
| WO | WO 2019013199 | | 1/2019 |
| WO | WO 2020/152444 | | 7/2020 |
| WO | WO 2020/152446 | | 7/2020 |
| WO | WO 2021176760 | | 9/2021 |
| WO | WO 2021/260353 | | 12/2021 |
| WO | WO 2022/054033 | | 3/2022 |
| WO | WO 2022054031 | | 3/2022 |
| WO | WO 2022123525 | | 6/2022 |

OTHER PUBLICATIONS

International Search Report & Written Opinion, International Patent Application No. PCT/IB2023/060285, dated Jan. 17, 2024, 5 pages.

* cited by examiner

CONTACT LENS PACKAGE WITH DRAINING PORT

The present application claims priority to U.S. application Ser. No. 17/953,947, filed Sep. 27, 2022, which is incorporated herein by reference in its entirety.

I. BACKGROUND OF THE INVENTION

In a conventional contact lens package, the contact lens typically sits in a molded plastic base having a cavity (or "bowl") that houses the contact lens in a bowl filled with solution. As a result, the user experience for transferring a contact lens from the package to an eye generally involves the user "fishing" the contact lens out of the bowl with a finger and then flipping the lens so that it is in the correct orientation on the finger for placement on the eye. This process requires touching the lens multiple times, which can transfer contaminants or pathogens from the hand to the lens and ultimately to the eye. Not only is this handling experience unsanitary, but it is also unduly cumbersome, messy, and mechanically stressful to the lens, which can tear, rip, or distort when overly manipulated.

In view of the growing awareness around ocular health and the customer demand for a more convenient experience, a need has arisen for contact lens packaging that enables a less messy and more sanitary contact lens handling process. Among other considerations: it would be desirable for wearers to be able to drain away any packaging solution which might impact the ability of adhering the lens to the finger, as variation in the amount of packaging solution adhering to the lens and package can impact the process of placing the lens on the finger. A mechanism for efficient draining of packing solution from the lens within the package prior to taking the lens from an opened contact lens package onto a user's finger can aid in the removal and insertion process.

The foregoing noted deficiencies of the prior art are merely exemplary and not exhaustive.

There remains a need for contact lens packages which provide a consistent solution draining if desired by the user.

II. SUMMARY

It has now been found that some or all the foregoing and related advantages may be attained in a contact lens package having one or more aspects described herein. For example, a contact lens package may have a base with a cavity that houses a contact lens and packaging solution, wherein the package is configured such that upon opening the package by a wearer the packaging solution drains away from the contact lens.

Thus, according to principles described herein a contact lens package includes a base having a proximal end and a distal end, a solution well between the proximal end and the distal end, a contact lens support in the solution well, a top opening between the proximal end and the distal end and over the contact lens support, and a via through a wall of the base adjacent the well, the via providing a fluid exit for solution within well. A removable lid overlying the top opening may be removably affixed over the top opening such that a user may remove the lid to access the contact lens. Optionally, the removable lid covers the via to block fluid exit of solution within the well until the removable lid is removed. The wall in which the via is formed may be an end wall at the distal end of the base. In such case, the removable lid may include a lid flap extending over the end wall to cover the via to block fluid exit of solution within the well until the removable lid is removed. The lid flap may be removable in such a way to unblock the via without dislodging the lid over the top opening. In an alternative aspect, the removable lid may include a tab overlying the via to block fluid exit of solution within the well. The tab may be removed without dislodging the lid over the top opening. In another option, the removable tab covers the via, separate from any portion of the lid, to block fluid exit of the solution within the well until the removable tab is removed.

In one optional configuration, the well is formed by a bottom wall of the base, an end wall at the distal end of the cavity and a front wall between a proximal edge of the base and the contact lens support. In an option, the front wall is neither perpendicular to nor parallel to the bottom wall of the well, e.g., may be a slanted portion from the proximal end of the base to the bottom wall of the base. In another option, the front wall is approximately parallel to the end wall to form a cavity that serves as the well cavity. In an option, the via is proximate to an intersection between the end wall and the bottom wall of the base.

A contact lens in a contact lens package having a base having a proximal end and a distal end, a solution well between the proximal end and the distal end, a contact lens support in the solution well, a contact lens held via the contact lens support, packaging solution in the well, a top opening between the proximal end and the distal end and over the contact lens support; a fluid port through a wall of the base adjacent the well, and a removable cover blocking the fluid port, may be accessed by removing the removable cover from blocking the fluid port; tipping the contact lens package to cause the solution to exit the well through the opened fluid port, and accessing the contact lens held by the contact lens support

III. BRIEF DESCRIPTION OF THE DRAWINGS

The foregoing and other features and advantages of the invention will be apparent from the following, more particular description of preferred embodiments of the invention, as illustrated in the accompanying drawings.

IV. DETAILED DESCRIPTION

Figures 1A, 1B, 1C, 1D:
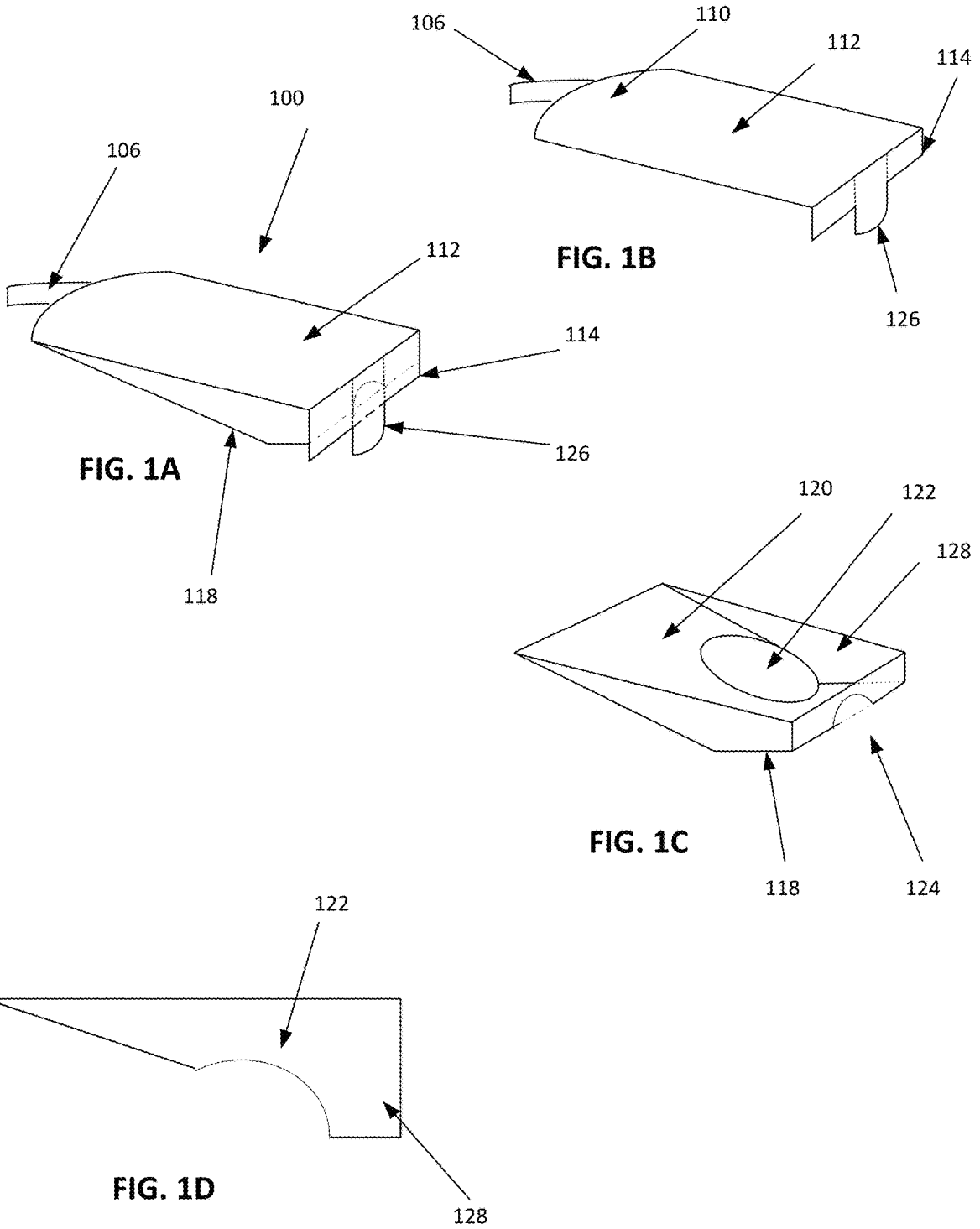
FIG. 1A illustrates an unopened contact lens package according to principles described herein.
FIG. 1B illustrates a lid of the contact lens package separate from a base of the contact lens package according to principles described herein.
FIG. 1C illustrates the base of the contact lens package with the lid removed according to principles described herein.
FIG. 1D illustrates a cross section of the base 118 of the contact lens package with the lid 112 removed according to principles described herein.

Reference will now be made in detail to representative embodiments illustrated in the accompanying drawings wherein reference numerals indicate certain elements. The following descriptions are not intended to limit the myriad embodiments to one preferred embodiment. To the contrary, it is intended to cover alternatives, modifications, and equivalents as can be included within the spirit and scope of the described embodiments as defined by the appended claims.

References to "one embodiment," "an embodiment," "some embodiments," "an example embodiment," etc., indicate that the embodiment described may include a particular feature, structure, aspect, or characteristic, but every embodiment may not necessarily include the particular feature, structure, or characteristic. Moreover, such phrases are not necessarily referring to the same embodiment. Further, when a particular feature, structure, aspect, or characteristic is described in connection with an embodiment, it is submitted that it is within the knowledge of one skilled in the art to effect such feature, structure, or characteristic in connection with other embodiments whether or not explicitly described.

Lens(es) or contact lens(es) refer to ophthalmic devices that reside on the eye. They have a generally hemispheric shape and can provide optical correction, cosmetic enhancement, UV blocking and visible light or glare reduction, therapeutic effect, including wound healing, delivery of drugs or neutraceuticals, diagnostic evaluation or monitoring, or any combination thereof. The term lens includes soft hydrogel contact lenses, which are generally provided to the consumer in a package in the hydrated state, and have a relatively low moduli, which allows them to conform to the cornea. Contact lenses suitable for use with the packages of the present invention include all hydrated contact lenses, including conventional and silicone hydrogel contact lenses.

A hydrogel is a hydrated crosslinked polymeric system that contains water in an equilibrium state, and may contain at least about 25%, or at least 35% water in the hydrated state. Hydrogels typically are oxygen permeable and biocompatible, making them excellent materials for producing contact lenses.

Conventional hydrogel contact lenses do not contain silicone containing components, and generally have higher water content, lower oxygen permeability, moduli, and shape memories than silicone hydrogels. Conventional hydrogels are prepared from monomeric mixtures predominantly containing hydrophilic monomers, such as 2-hydroxyethyl methacrylate ("HEMA"), N-vinyl pyrrolidone ("NVP") or polyvinyl alcohols. U.S. Pat. Nos. 4,495,313, 4,889,664 and 5,039,459 disclose the formation of conventional hydrogels. Conventional hydrogels may be ionic or non-ionic and include polymacon, etafilcon, nelfilcon, ocufilcon lenefilcon and the like. The oxygen permeability of these conventional hydrogel materials is typically below 20-30 barrers.

Silicon hydrogel formulations include balafilcon samfilcon, lotrafilcon A and B, delfilcon, galyfilcon, senofilcon A, B and C, narafilcon, comfilcon, formofilcon, riofilcon, fanfilcon, stenfilcon, somofilcon, kalifilcon and the like. "Silicone hydrogels" refer to polymeric networks made from at least one hydrophilic component and at least one silicone-containing component. Silicone hydrogels may have moduli in the range of 60-200, 60-150 or 80-130 psi, water contents in the range of 20 to 60%. Examples of silicone hydrogels include acquafilcon, asmofilcon, balafilcon, comfilcon, delefilcon, enfilcon, fanfilcon, formofilcon, galyfilcon, lotrafilcon, narafilcon, riofilcon, samfilcon, senofilcon, somofilcon, and stenfilcon, verofilcon, including all of their variants, as well as silicone hydrogels as prepared in U.S. Pat. Nos. 4,659,782, 4,659,783, 5,244,981, 5,314,960, 5,331,067, 5,371,147, 5,998,498, 6,087,415, 5,760,100, 5,776,999, 5,789,461, 5,849,811, 5,965,631, 6,367,929, 6,822,016, 6,867,245, 6,943,203, 7,247,692, 7,249,848, 7,553,880, 7,666,921, 7,786,185, 7,956,131, 8,022,158, 8,273,802, 8,399,538, 8,470,906, 8,450,387, 8,487,058, 8,507,577, 8,637,621, 8,703,891, 8,937,110, 8,937,111, 8,940,812, 9,056,878, 9,057,821, 9,125,808, 9,140,825, 9,156,934, 9,170,349, 9,244,196, 9,244,197, 9,260,544, 9,297,928, 9,297,929 as well as WO 03/22321, WO 2008/061992, and US 2010/0048847. These patents are hereby incorporated by reference in their entireties. Silicone hydrogels may have higher shape memory than conventional contact lenses.

Hydrogel lenses are viscoelastic materials. Contact lenses can form optical distortions if the lens interacts with either the package or any air bubble in the package. The extent of the optical distortions, and the length of time needed for the distortions to relax out will vary depending on the chemistry, and to a lesser extent, geometry of the lens. Conventional lens materials, such as polyhydroxyethyl methacrylate-based lenses like etafilcon A or polymacon have low loss modulus and tan delta compared to silicone hydrogels and may form fewer and less severe optical distortions as a result of contact with packaging. The incorporation of silicones (which generally increase the bulk elastic response), wetting agents such as PVP (which generally increase the viscous response) or coatings of conventional hydrogel materials (which may lower the elastic response at the lens interface) can alter the lens viscoelastic properties. Conventional hydrogel contact lenses and silicone hydrogel contact lenses having short or stiff crosslinking agents and or stiffening agent have short shape memories and may be less susceptible to deformation during storage. As used herein, high or higher shape memory hydrogels display optical distortions from contact with an air bubble or package of at least about 0.18 after 5 weeks of accelerated aging at 55° C. Viscoelastic properties, including loss modulus and tan delta, can be measured using a dynamic mechanical analysis.

The contact lenses can be of any geometry or power, and have a generally hemispherical shape, with a concave posterior side which rests against the eye when in use and a convex anterior side which faces away from the eye and is contacted by the eyelid during blinking.

Embodiments may include a lens support surrounded by a sealable cavity also interchangeably referred to as a chamber. The cavity may have any convenient form and may comprise a package base and at least a lid, each of which are described in detail below. As used herein, the phrases "the lid", "a lid", "the base" and "a base" encompass both the singular and plural. The lid and package base are sealed to each other to form a cavity which holds the contact lens, support and packaging solution in a sterile state during shipping and storage prior to use. The contact lens package is made from materials which are compatible with the contact lens and solution, as well as retortable and biologically inert.

"Film" or "multilayer film" are films used to seal the package and are often referred to as lidstock. Multilayer films used in conventional contact lens packages may be used in the packages of the present invention as the base, a component of the lid, or both. Multilayer films comprise a plurality of layers, including barrier layers, including foil layers, or coatings, seal layers, which seal the film to the rest of the package, and may also comprise additional layers selected from peel initiation layers, lamination layers, and layers that improve other package properties like stiffness, temperature resistance, printability, puncture resistance, barrier resistance to water or oxygen and the like. The multilayer films form a steam sterilizable (retortable) seal. The multilayer film can include PET, BON or OPP films layers to increase stiffness and temperature resistance, or to EVOH or PVDC coatings to improve barrier resistance to oxygen or moisture vapor.

An "unopened state" or "unopened" as used herein refers to a contact lens package that is closed and houses a contact lens in solution.

An "opened state" or "opened" as used herein refers to a contact lens package after the sterile seal has been broken. Depending on the context described herein, the open state extends to the state of the package when the user has manipulated the package to cause the lens to be lifted out of the packaging solution for transfer by the user.

A "wearer" or "user" as used herein refers to a person opening a contact lens package. The user is generally referred to as the person who both opens the package and transfers the contact lens contained therein to their eye. However, the user in some contexts may be a person handling the lens package on behalf of the wearer, such an eye care provider ("ECP") or another individual demonstrating for or assisting the wearer.

Packaging solution is any physiologically compatible solution, which is compatible with the selected lens material and packaging. Packaging solutions include buffered solutions having a physiological pH, such as buffered saline solutions. The packaging solution may contain known components, including buffers, pH and tonicity adjusting agents, lubricants, wetting agents, nutraceuticals, pharmaceuticals, in package coating components and the like.

References throughout this description to injection molding processes and the use of materials conventionally applied to injection molding should be understood as exemplary. Those of skill in the art will appreciate that other means of manufacture are possible within the scope of the appended claims, including but not limited to alternative molding processes, thermoforming, 3D printing, and the like. Likewise, references to heat seals and heat sealing are exemplary to embodiments described herein. Other means of securing packaging components will be apparent to those skilled in the art, including the use of adhesive, glue, thermal bonding, welding such as heat, ultrasonic or laser welding, or a mechanical trap, and the like.

FIGS. 1A-1C illustrate components of a contact lens package according to an exemplary embodiment of the present invention. FIG. 1A illustrates an unopened contact lens package 100 according to principles described herein. FIG. 1B illustrates a lid 112 of the contact lens package 100 separate from a base 118 of the contact lens package. FIG. 1C illustrates the base 118 of the contact lens package 100 with the lid 112 removed. FIG. 1D illustrates a cross section of the base 118 of the contact lens package 100 with the lid 112 removed.

An unopened contact lens package 100 includes a base 118 and a lid 112 covering the base. The lid 112 may include an opening tab 110 at a proximal end of the base, which may be integral to lid 112. In an optional configuration, the opening tab 110 may be affixed to or integral with the lid 112, but at least partially unattached to the base 118 but moveably connected to the lid 112 so that the opening tab 110 may be grasped by a user.

As illustrated in FIGS. 1A and 1B, the lid 112 of the contact lens package 100 may also include a grasping member 106 operatively connected to the lid 112 or the opening tab 110, as shown at FIG. 1A. The grasping member 106 may be provided to aid the user in opening the package and may be made of plastic or be an extension of the opening tab 110 or lid 112, as appropriate. The grasping member 106 may be textured to aid in the grasping for removal of the lid 112, the direction of which is indicated by the leftmost arrow in FIG. 1A. In any of the embodiments described herein, the opening tab 110 and lid 112 are formed of a film or multilayer film as described herein.

As illustrated in FIG. 1C, the contact lens package 100 further includes a base 118 comprising a cavity 120. In the illustrated embodiment, the cavity 120 includes a well 128 that holds packaging solution when the package is in an unopened state. The base further includes a lens support 122, which may be convex, as illustrated in FIG. 1D. It is noted that, while illustrated as a convex lens support 118, the cavity 120 may include or be a "bowl" type lens support without departing from the principles described herein.

As illustrated in FIG. 1C, the base 118 includes a via or fluid port 124 at the distal end of the base 118, which, in an unopened state is blocked or closed by the lid 112 or other mechanism, such as a tab 126. As illustrated in FIG. 1C, the base may include a well 128 adjacent to the contact lens support 122, the well 128 is in fluid communication with the contact lens support 122 and the opening such that fluid drains away from the contact lens into the well 128 and out of the package 100 via the port 124. The port 124 is located adjacent to an in fluidic communication with the well 128 such that packaging solution may drain from the well 128 when the port 124 is opened, unblocked or pierced, e.g., be removing a removable cover. When the contact lens package 100 is in an unopened state, as in FIG. 1A, the port 124 is fluidically sealed by the lid 112 or other mechanism, such as tab 126. The lid 112 may further include a flap 114 that extends over the distal end of the base 118 of the contact lens package where it is sealed to the base 118 to provide the fluidic seal of the cavity 120 and/or the port 124 until the lid is removed by the user. The distal end of the lid 112 may include distal tab 126 by which the user may open the fluidic seal at the distal end of the contact lens package to open the port 124, causing the packaging solution 130 to drain from the cavity 120 within the base 118. Draining the solution liquid may be performed by tipping the contact lens package to urge the solution through the port by gravitational force or, optionally, by squeezing or shaking the package to cause inertial forces to drain the solution.

Figure 3A:
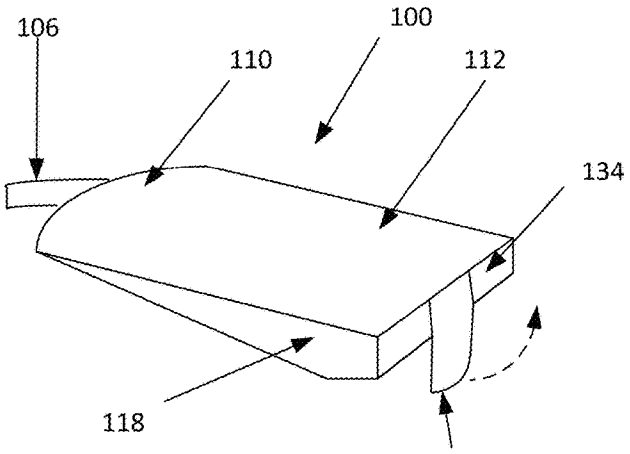
FIGS. 3A-3D illustrate opening a contact lens package, draining packaging solution and removing a contact lens according to principles described herein.

Optionally, the lid flap 114 provides the seal that blocks the port 124 in an unopened state. The contact lens package 100 may optionally include a removable tab 126 that blocks the port 124, whereby the user may remove the tab 126 separately from the lid 112 to drain the packaging solution from the well 128 without removing the lid 112 from the base. For example, in one aspect, the tab 126 may be used to pry up the entire lid flap 114 to expose the drain port 124 (or drain port 224, as illustrated in FIGS. 4A-C and 5A-D), may be a part of the lid flap 114 that may be separately removable from the lid flap 114, such as by perforations or thinned structure, as illustrated in FIGS. 1A and 4A, or may be a component that covers the drain port 124/224 in the absence of a lid flap 114, as shown in FIG. 3A. Such configuration allows the user to drain the packaging fluid from the well 128 without exposing the contact lens to the outside environment or risking dislodging the contact lens or it falling out of the opened package during draining of the packaging solution via the port. In any of the described embodiments, the removable tab 126 may be part of the package in lieu of the lid flap 114 or in addition to the lid flap 114. In some embodiments, a protrusion or other additional structure may be disposed within the base or lid of the package to prevent the lens from sliding into and blocking the port. It is also noted some embodiments may additionally include an air entry route in addition to the port. An air entry route may be effected in myriad ways, such as by allowing the lid to be partially opened at the opposite end of the port.

Figure 2A:
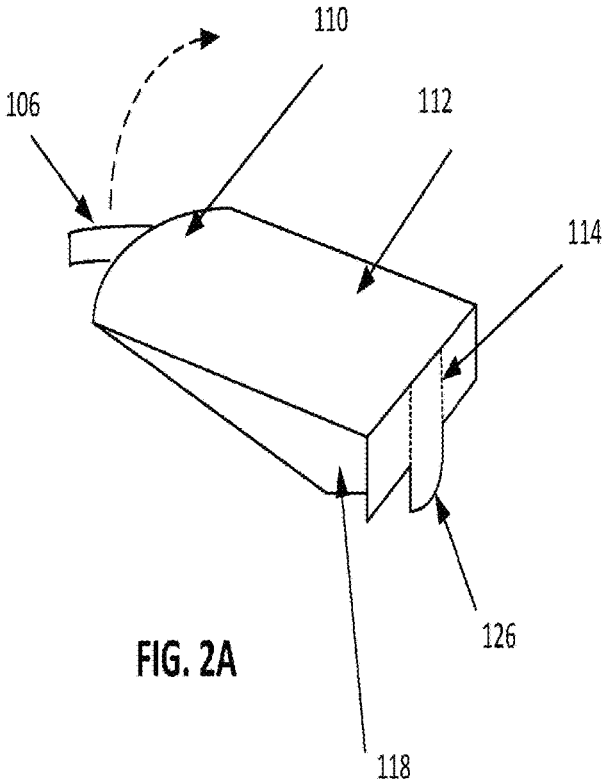
FIGS. 2A-2D illustrate opening a contact lens package, draining packaging solution and removing a contact lens according to principles described herein.
Figure 2B:
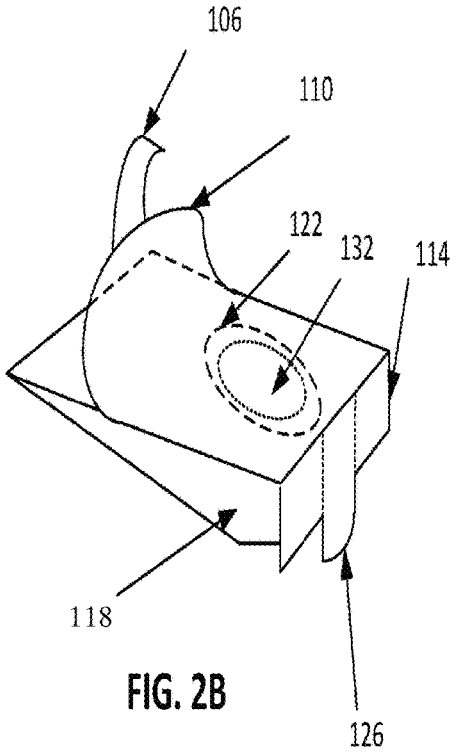

As illustrated in FIG. 2A, to access the contact lens, a user holds an unopened contact lens package 100 and pulls the opening tab 110 of the lid 112 of the package 100 in the direction of the arrow. The opening may be assisted by the user grasping optional grasping tab 106, which in turn is affixed to or integral with the opening tab 110 and/or the lid 112. Although not required, the user may grasp the package 100 with one hand and pull the opening tab 110 with the other hand. As illustrated at step shown in FIG. 2B, pulling the opening tab 110 causes the lid 112 to bend and break a seal between the lid 112 and a base 118 of the package 100. The lid 112 may be a multilayer film or laminated foil seal that is heat sealed to an upper portion of the package comprising opening tab 110, the lid 112, and optionally the grasping member 106 lens support 126 and the lid flap 114 at the distal end of package 100.

Figure 2C:
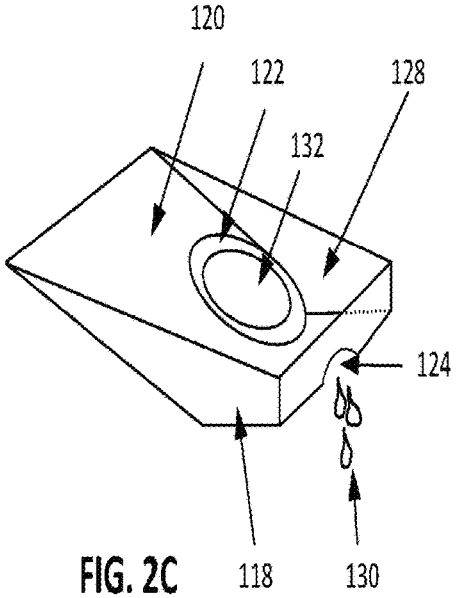
Figure 2D:
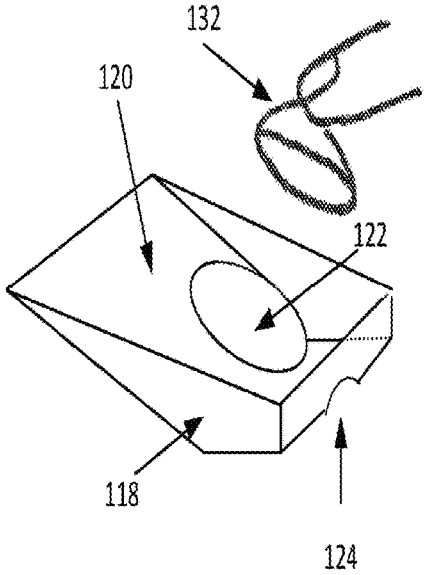

As mentioned above, the port 124 at the distal end of the package 100 is fluidically connected to the well 128. As shown in FIG. 2C, the lid 112 may be configured to fluidically seal the port 124 such that removal of the lid 112 opens the port 124, allowing the packaging solution 130 within the well 128 to drain away from the contact lens on the lens support and exit the well 128 via the port 124. The contact lens 132, thus exposed by removal of the lid 112 and draining of the packaging solution 130 allows a user to access the contact lens 122 and dab the contact lens 132 to remove it for insertion into the wearer's eye.

FIGS. 3A-D illustrate features of the optional distal tab 126. As shown in FIG. 3A, the optional distal tab 126 may be configured to be moved away from the port 124 with the remainder of the lid 112 remaining in place. The user grasps the distal tab 126, which is heat sealed or otherwise removably affixed to the base 118. Moving the distal tab 126 away from base end wall 134 reveals and opens the port 124, allowing the packaging solution 130 to be released from the well 128. Draining the solution liquid may be performed by tipping the contact lens package to urge the solution through the port by gravitational force.

Figure 3B:
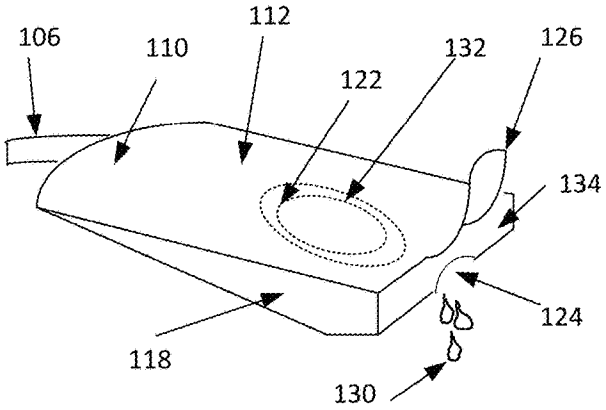
Figure 3C:
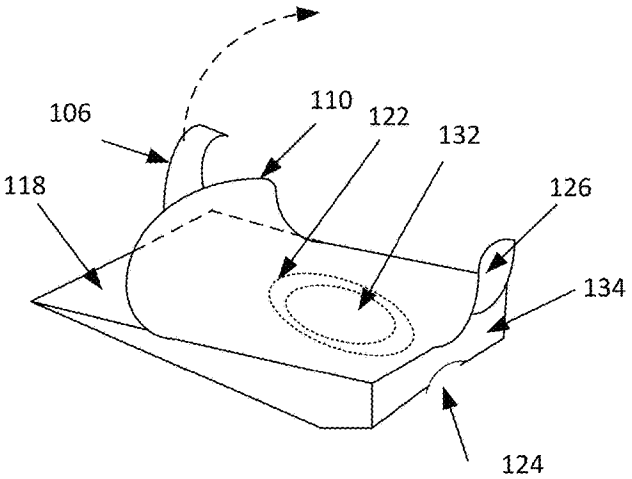
Figure 3D:
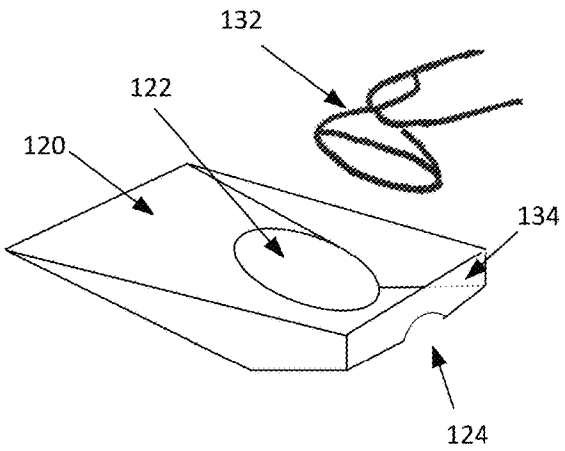

In the illustration of FIGS. 3A-3C, the distal tab 126 is integral to the lid 112, but this configuration is not essential. The distal tab 126 may be separate from the lid 112 and/or may be under the lid flap 114, in which case movement of the distal tab 126 would dislodge the lid flap, such that the lid 112 may be removed by grasping the lid flap 114 from the distal end of the contact lens package.

Figure 4B:
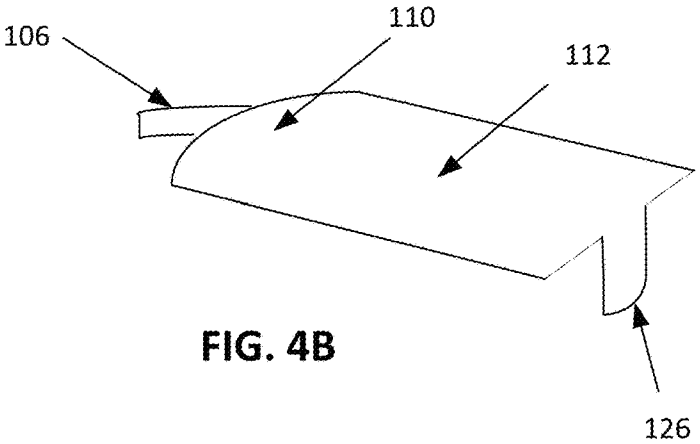
FIGS. 4A-4C illustrate an embodiment of a contact lens package with a drain port through an end wall, according to principles described herein.
Figure 4C:
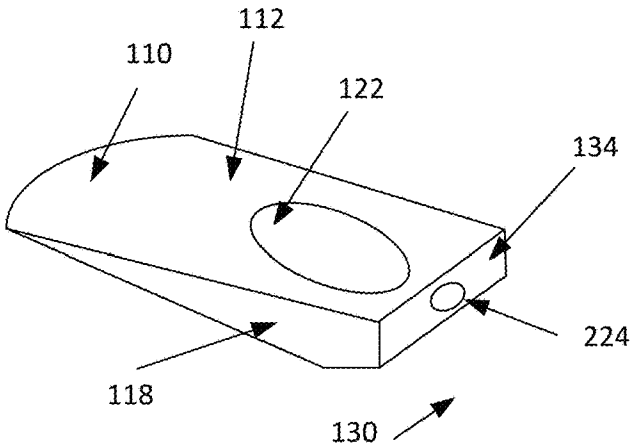
Figure 4A:
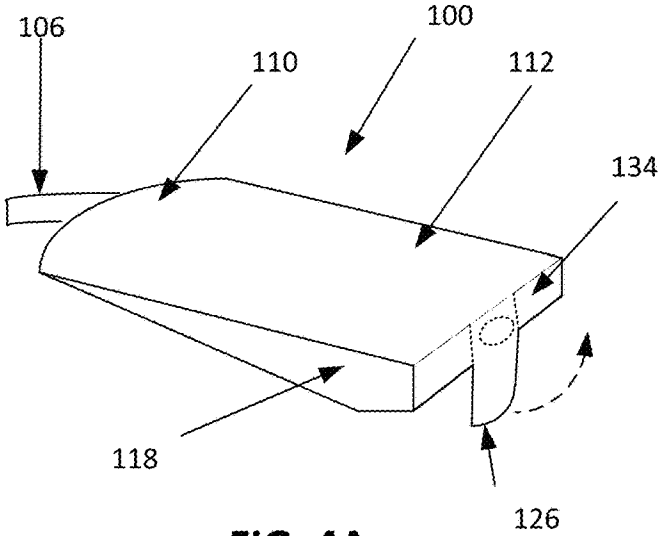

FIGS. 4A-C illustrate optional or alternative features of the contact lens package according to principles described herein. As illustrated in FIG. 4A, on alternative configuration of the drain port 224 is a via through distal end wall 134 of the base 118 spaced away from a lower edge of the distal end wall. The shape of the via 224 is not specifically any particular shape, even though illustrated in FIGS. 4 and 5 as having a circular or elliptical profile. Any other shape of the profile is possible without departing from the spirit and scope of the invention. For example, an arcuate or a polygonal profile are possible and within the scope of this disclosure. FIGS. 4A and 4B also illustrate the lid 112 (without a lid flap 114 of FIG. 1) integral with the tab 126. FIG. 4C also illustrates the lid 112 with integral the tab 126 such that the tab 126 can be articulated with respect to the lid 112, but is not specifically designed to be removed from the lid 112.

Figure 5A:
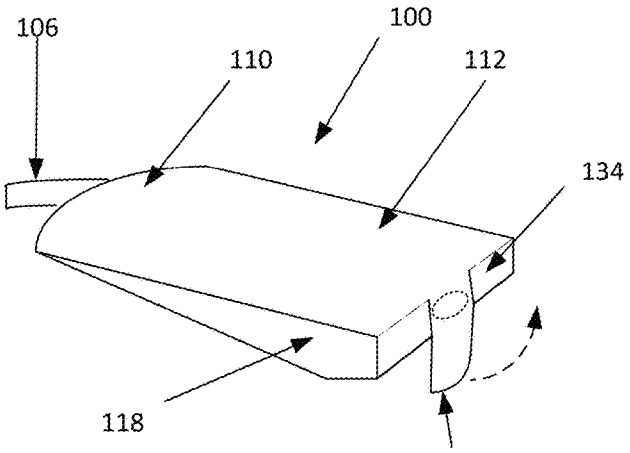
FIGS. 5A-5D illustrate opening a contact lens package of FIGS. 4A-4C, draining packaging solution and removing a contact lens according to principles described herein.
Figure 5B:
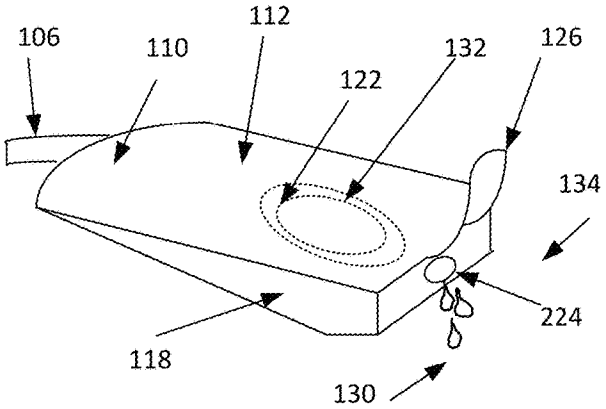
Figure 5C:
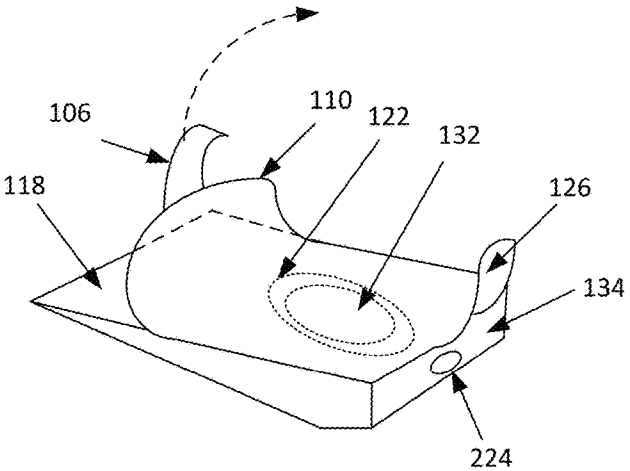
Figure 5D:
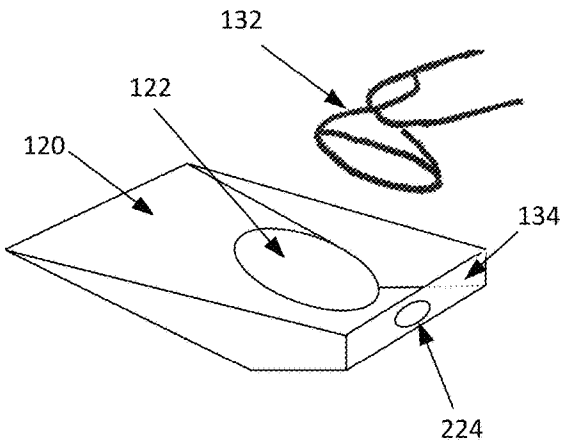

As shown in FIG. 5A, the distal tab 126 may be configured to be moved away from the port 124 with the remainder of the lid 112 remaining in place. The user grasps the distal tab 126, which is heat sealed or otherwise removably affixed to the base 118. Moving the distal tab 126 away from base end wall 134 reveals and opens the port 124, allowing the packaging solution 130 to be released from the well 128. Draining the solution liquid may be performed by tipping the contact lens package to urge the solution through the port by gravitational force. After draining the liquid, the user may then remove the lid 112 by grasping the opening tab 110 of the lid 112 or the optional grasping member 106 to remove the lid from the base to access the contact lens 132, as illustrated in FIG. 5D.

Figure 6B:
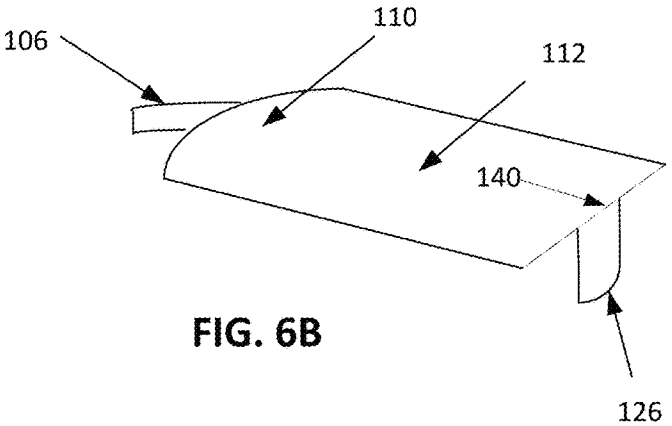
FIGS. 6A-6C illustrate an embodiment of a contact lens package with a drain port through an end wall, according to principles described herein.
Figure 6C:
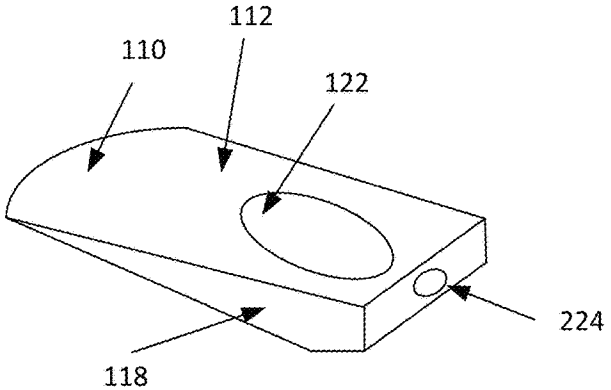
Figure 6A:
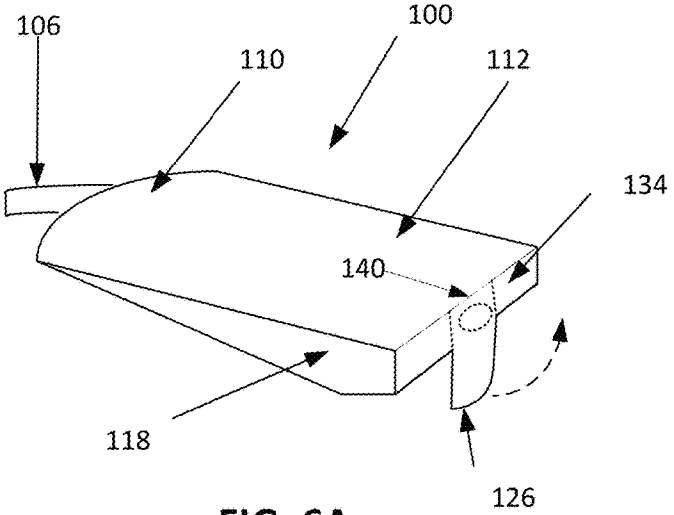

FIGS. 6A-C illustrate optional or alternative features of the contact lens package according to principles described herein. As illustrated in FIG. 4A, on alternative configuration of the drain port 224 is a via through distal end wall 134 of the base 118 spaced away from a lower edge of the distal end wall. The shape of the via 224 is not specifically any particular shape, even though illustrated in FIGS. 6 and 7 as having a circular or elliptical profile. Any other shape of the profile is possible without departing from the spirit and scope of the invention. For example, an arcuate or a polygonal profile are possible and within the scope of this disclosure. FIGS. 6A and 6B also illustrate the lid 112 (without a lid flap 114 of FIG. 1) integral with the tab 126. FIG. 6B illustrates the lid 112, and as illustrated, the tab 126 optionally may be removable from the lid 112, which may be facilitated by perforations 140 to reduce force required for a user to remove or tear away the tab 126 from the lid 112. Other frangible connections may be used in place of the perforation, such as thinned material structure or other frangible connection (not shown)

In an alternate configuration (not shown), the tab 126 may be entirely separate from the lid 112, for example, separately heat sealed over the via 224. FIGS. 1A-D and 2A-D illustrate a lid having a full flap 114 that overlies a distal base end wall 134, but according to principles of the present invention, in an optional configuration, the contact lens package 100 may include a separate removable piece or tab 126 that overlies the drain port 124/224 to prevent leakage of the contact lens packaging solution from the well of the base prior to opening of the drain port 124/224.

Figure 7A:
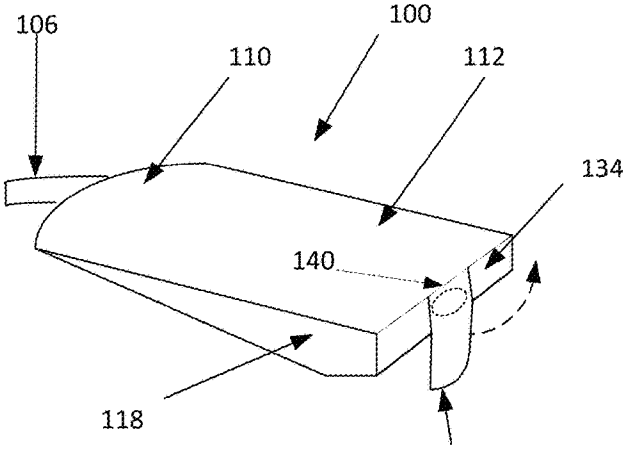
FIGS. 7A-7D illustrate opening a contact lens package of FIGS. 6A-6C, draining packaging solution and removing a contact lens according to principles described herein.
Figure 7B:
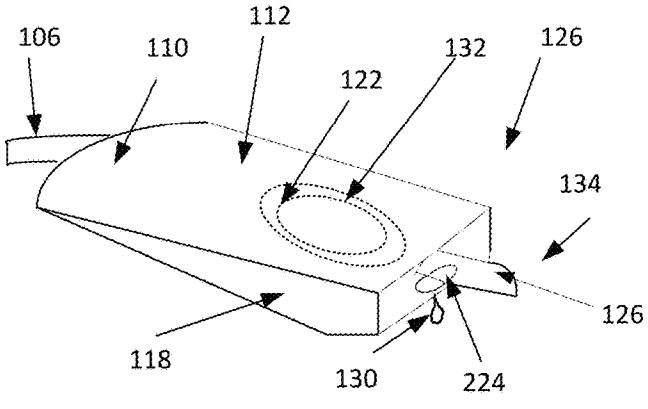
Figure 7C:
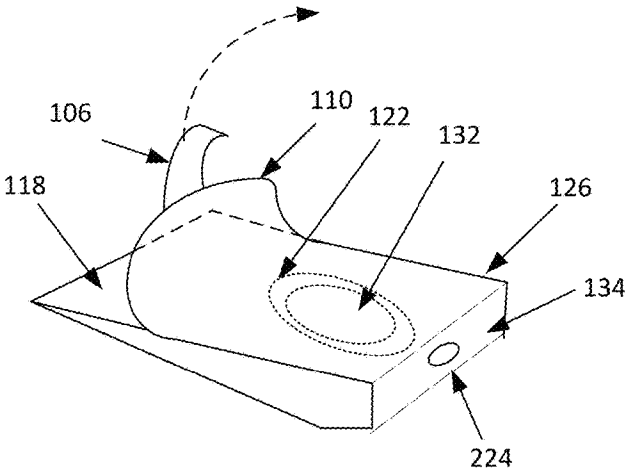
Figure 7D:
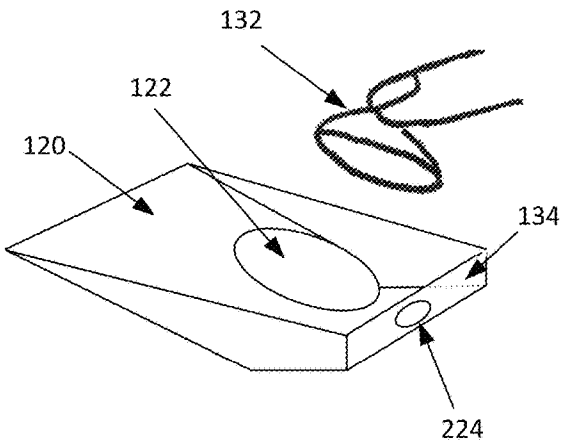
Figure 8A:
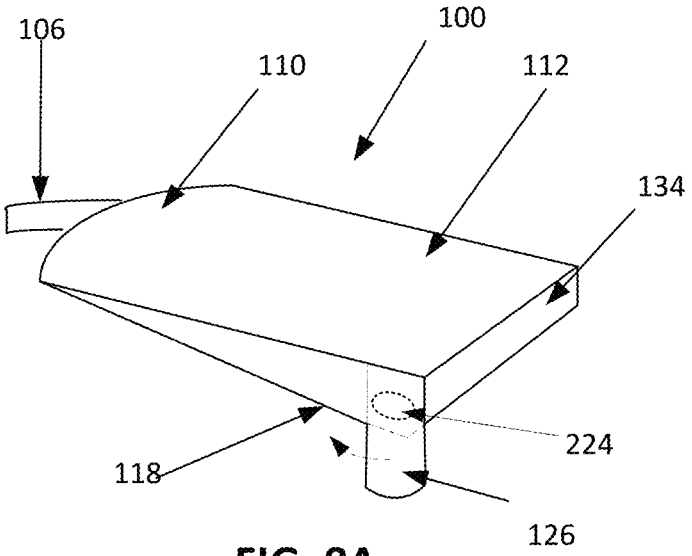
FIGS. 8A and 8B illustrate alternative locations of drain ports according to principles described herein.
Figure 8B:
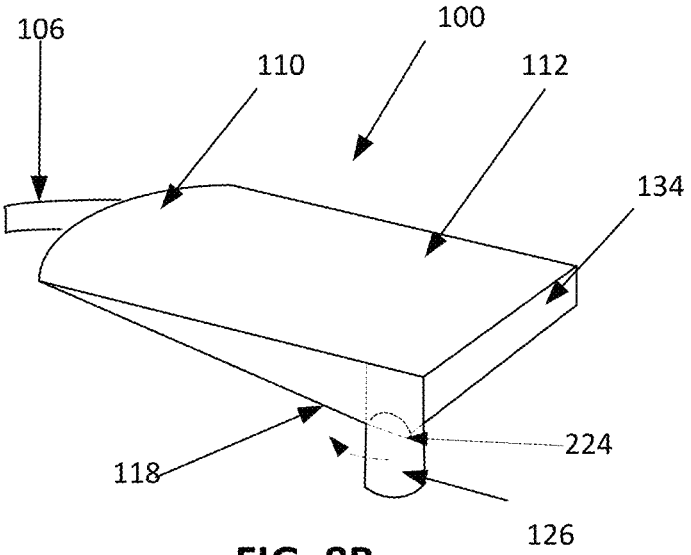

FIGS. 7A-7D illustrate operation of the contact lens package of FIGS. 6A-6C. In the illustration of FIGS. 6A-6C, the distal tab 126 is integral to but removable from the lid 112. To access the contact lens, the user grasps the distal tab 126, which is heat sealed or otherwise removably affixed to the base 118. Moving the distal tab 126 away from base end wall 134 reveals and opens the port 124, allowing the packaging solution 130 to be released from the well 128. Referring to FIG. 7B, the user may tear the tab 126 away from the lid 112 so that the lid 112 remains affixed to the base 118, thereby leaving the contact lens cavity fully fluidically sealed from above by the lid even though the drain port 224 has been opened. Draining the solution liquid may be performed by tipping the contact lens package to urge the solution through the port by gravitational force. After draining the liquid, the user may then remove the lid 112 by grasping the opening tab 110 of the lid 112 or the optional grasping member 106 to remove the lid from the base to access the contact lens 132, as illustrated in FIG. 5D. While described herein as having the drain port in a distal end, distal edge or distal wall of the base, the drain port may instead be included in any wall of the base, so long as there is a means for blocking the drain port, such as a removable tab similar to removable tab 126. Referring to FIG. 8A a drain port 124 may be in a side wall 142 of the base 118. Referring to FIG. 8B, a via may be in a side wall 142 of the base 118. As described with respect to previous embodiments of the tab 126, the tab 126 over a drain port/via 124/224 in the side wall may be integral to or removable from the lid 112, e.g. facilitated by perforations, thinned structure or other frangible connection (not shown). The shape of the via 224 is not specifically any particular shape, even though illustrated in FIGS. 8A and 8B as having an arcuate, circular or elliptical profile. Any other shape of the profile is possible without departing from the spirit and scope of the invention. For example, an arcuate or a polygonal profile are possible and within the scope of this disclosure.

Thus, according to principles described herein a contact lens package includes a base having a proximal end and a distal end, a solution well between the proximal end and the distal end, a contact lens support in the solution well, a top opening between the proximal end and the distal end and over the contact lens support, and a port through a wall of the base adjacent the well, the port providing a fluid exit for solution within well. A removable lid overlying the top opening may be removably affixed over the top opening such that a user may remove the lid to access the contact lens. Optionally, the removable lid covers the port to block fluid exit of solution within the well until the removable lid is removed. The wall in which the port is formed may be an end wall at the distal end of the base. In such case, the removable lid may include a lid flap extending over the end wall to cover the port to block fluid exit of solution within the well until the removable lid is removed. The lid flap may be removable in such a way to unblock the port without dislodging the lid over the top opening. In an alternative aspect, the removable lid may include a tab overlying the port to block fluid exit of solution within the well. The tab may be removed without dislodging the lid over the top opening. In another option, the removable tab covers the port, separate from any portion of the lid, to block fluid exit of the solution within the well until the removable tab is removed.

In one optional configuration, the well is formed by a bottom wall of the base, an end wall at the distal end of the cavity and a front wall between a proximal edge of the base and the contact lens support. In an option, the front wall is neither perpendicular to nor parallel to the bottom wall of the well, e.g., may be a slanted portion from the proximal end of the base to the bottom wall of the base. In another option, the front wall is approximately parallel to the end wall to form a cavity that serves as the well cavity. In an option, the port is proximate to an intersection between the end wall and the bottom wall of the base.

In the above-described aspects, the fluidic seal (not shown) may be made of any suitable frangible material suitable for packaging medical devices, including a molded sheet of foil or plastic, laminate films, or plastic. Multilayer films used in conventional contact lens packages may be used, a component of the fluidic seal. Multilayer films comprise a plurality of layers, including barrier layers, including foil layers, or coatings, seal layers, which seal the film to the rest of the package, and may also comprise additional layers selected from peel initiation layers, lamination layers, and layers that improve other package properties like stiffness, temperature resistance, printability, puncture resistance, barrier resistance to water or oxygen and the like. The multilayer films form a steam sterilizable (retortable) seal. The multilayer film can include PET, BON or OPP films layers to increase stiffness and temperature resistance, or to EVOH or PVDC coatings to improve barrier resistance to oxygen or moisture vapor.

The foregoing description, for purposes of explanation, used specific nomenclature to provide a thorough understanding of the described embodiments. However, it will be apparent to one skilled in the art that many of the specific details are not required in order to practice the described embodiments. Thus, the foregoing descriptions of the specific embodiments described herein are presented for the purposes of illustration and description. They are not targeted to be exhaustive or to limit the embodiments to the precise forms disclosed. It will be apparent to one of ordinary skill in the art that many modifications and variations are possible in view of the above teachings.

The Summary and Abstract sections may set forth one or more but not all exemplary embodiments of the present invention as contemplated by the inventors, and thus, are not intended to limit the present invention and the appended claims in any way.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The packages of the present invention may be manufactured using known materials and processes. The packaging materials may be virgin, recycled or a combination thereof. The volume within the package cavity can vary depending on the design selected.

Not all the features described herein need to be incorporated into every package, and those of skill in the art, using the teachings herein, can combine the features to provide a wide variety of improved contact lens packages. In summary, the contact lens packages of the present invention incorporate several novel functionalities which may be combined in a wide variety of combinations as described herein to provide the desired improved packaging. The breadth and scope of the present invention should not be limited by any of the above-described exemplary embodiments but should be defined only in accordance with the following claims and their equivalents.

What is claimed is:

1. A method of accessing a contact lens in a contact lens package comprising a base having a proximal end and a distal end, a solution well between the proximal end and the distal end, a contact lens support in the solution well, a contact lens held via the contact lens support, packaging solution in the well, a top opening between the proximal end and the distal end and over the contact lens support; a fluid port through a wall of the base adjacent the well, and a movable cover blocking the fluid port, the method comprising:

removing the movable cover to open the fluid port;

tipping the contact lens package to cause the solution to exit the well through the opened fluid port, and accessing the contact lens held by the contact lens support.

2. The method of claim 1, wherein the contact lens package further comprises a removable lid over the top opening.

3. The method of claim 2, further comprising removing the removable lid after tipping the contact lens package.

4. The method of claim 2, further comprising removing the removable lid before tipping the contact lens package.

5. The method of claim 2, wherein the movable cover is affixed to the removable lid.

6. The method of claim 5, wherein the movable cover is integral to the removable lid.

7. The method of claim 1, wherein the wall is an end wall and the movable cover is a flap extending along the end wall to cover the fluid port.

8. The method of claim 2, wherein the movable cover extends from the removable lid and is frangibly connected to the removable lid.

9. The method of claim 2, wherein the movable cover is separate from the removable lid.

10. The method of claim 2, wherein the movable cover is a flap extending from the removable lid over the wall of the base to cover the fluid port to block fluid exit of solution within the solution well until the removable lid is removed.

11. The method of claim 2, wherein the movable cover is a flap extending from the removable lid over the wall of the base to cover the fluid port to block fluid exit of solution within the solution well, wherein the flap is movable to unblock the fluid port without dislodging the removable lid over the top opening.

12. The method of claim 11, wherein the flap is frangibly connected to the removable lid for removal without dislodging the removable lid over the top opening.

13. The method of claim 12, wherein the frangible connection between the removable lid and the flap is provided by a perforation between the removable lid and the flap.

14. The method of claim 1, wherein the wall is one of a side wall, an end wall, or a bottom wall of the base.

15. The method of claim 1, wherein the contact lens support is concave with respect to a bottom of the well.

16. The method of claim 1, wherein the contact lens support is convex with respect to a bottom of the well.

17. The method of claim 1, wherein the well comprises a bottom wall of the base, an end wall at the distal end of the cavity, and a front wall between a proximal edge of the base and the contact lens support.

18. The method of claim 17, wherein the fluid port is proximate to an intersection between the end wall and the bottom wall of the base.

* * * * *